United States Patent [19]

Willbanks

[11] Patent Number: 5,066,852

[45] Date of Patent: Nov. 19, 1991

[54] THERMOPLASTIC END SEAL FOR ELECTRIC HEATING ELEMENTS

[75] Inventor: Henry O. Willbanks, Cookeville, Tenn.

[73] Assignee: Teledyne Ind. Inc., Cookeville, Tenn.

[21] Appl. No.: 583,248

[22] Filed: Sep. 17, 1990

[51] Int. Cl.[5] ..... H05B 3/10

[52] U.S. Cl. ..... 219/544; 219/541; 338/274

[58] Field of Search ..... 219/541, 544; 338/238, 338/239, 240, 241, 274, 275; 29/611, 614

[56] References Cited

U.S. PATENT DOCUMENTS 4,376,245 3/1983 Lindskog et al. ..... 219/544
4,586,020 4/1986 Naruo et al. ..... 338/238

FOREIGN PATENT DOCUMENTS 0136738 11/1978 Japan ..... 29/611

*Primary Examiner*—Bruce A. Reynolds

*Assistant Examiner*—Michael D. Switzer

*Attorney, Agent, or Firm*—Dennison, Meserole, Pollack & Scheiner

[57] ABSTRACT

An electric heating device is disclosed which comprises a generally tubular sheath, an elongated coil of electrical resistance heating wire passing through a portion of the sheath, and a metal terminal at each end of the sheath. The interior of the sheath is filled with a granular heat conducting, electrically insulating material, and the sheath is sealed at at least one end with a thermoplastic material having a melting temperature in the range of the temperature of the terminal when the heating device is in heated condition. The thermoplastic material must be substantially permeable to gases while melted and substantially impermeable to gases while solid. The use of such a seal enables the heating element to consume oxygen in a normal manner while hot, but will prevent the entry of moisture into the element while the element is cool and the seal is in a solid condition.

11 Claims, 1 Drawing Sheet

THERMOPLASTIC END SEAL FOR ELECTRIC HEATING ELEMENTS

BACKGROUND OF THE INVENTION

The present invention relates to tubular electric heating elements.

Tubular electric heating elements are commonly used in domestic appliances such as ovens, ranges, toasters and broilers but also have a wide variety of industrial applications.

The tubular heating element is formed of a generally tubular metal sheath serving as the casing. The generally tubular sheath can have any one of a variety of cross-sectional shapes, including circular, oval, rectangular, hexagonal, etc. A resistance wire, wound to a given diameter and fitted with a terminal at each end, makes up the helix assembly or working part of the heating element. The helix assembly lies at the core of the sheath and runs its length, with the terminals extending past the ends of the sheath to provide for electrical connections. A powder, typically magnesium oxide, fills the space between the helix and the inside wall of the tube to serve as an electrical insulator and heat conductor. Heating elements properly annealed can be formed to the desired shape.

In general, tubular electric heating elements may be operated at temperatures to about two thousand degrees Fahrenheit. While the coil of resistance wire may reach a very high temperature, the terminal at each end remains relatively cool and is therefore known as a "cold pin". The terminals passing through the ends of the heating element typically remain in a temperature range of 150° to 200° F.

Seals are necessary at each end of the tubular heating element. The seals serve as an electrical insulator between the sheath and the terminal and retard or prevent the entrance of water into the heating element. Resin bushings have been used as end seals, such as in U.S. Pat. No. 4,182,948, but better sealing has been obtained with end seals formed in-situ from glass, ceramics and polymers. These formed in-situ seals can be hermetic seals or "breathing" seals.

Hermetic seals serve as a substantially impervious barrier to entry of gases and liquids at each end of the heating element, and have been formed of glass or a ceramic in the prior art, for example, in U.S. Pat. Nos. 3,195,093, 4,034,330, and 4,506,251. In addition, epoxy materials are known for use as hermetic seals, as they are thermosetting and cure to heat resistant and substantially impervious materials.

Hermetic seals, however, present a problem when used with elements having an operating temperature of 1000° F. or more. Elements operating at these high temperatures consume oxygen inside the sheath by oxidation of the sheath and the wire. Once the existing supply of oxygen within the sheath is exhausted, additional oxygen consumption may take place by breakdown of the insulating material. As reported in U.S. Pat. No. 3,195,093, it is possible that a vacuum will be formed within the sheath, leading to a decrease in the thermal conductivity of the insulating material and a commensurate increase in the temperature of the wire, resulting in vaporization and failure of the resistance wire after a relatively short time.

In order to avoid the problems inherent in the use of hermetic seals with high temperature heating elements, it is also known to utilize "breathing" end seals with such heating elements. To form breathing end seals, a thermosetting silicone fluid is applied to the sheath ends, and allowed to wick into the element. When a wick depth of 1 to 3 inches occurs, heat is applied to make the fluid gel. The silicone seals are permeable to air, and allow normal oxidation to take place within the sheath.

While breathing seals do allow air to pass through to the inside of the sheath at high temperatures, they also allow water vapor to pass through to the inside of the sheath at low temperatures. Without routine operation, elements with breathing seals accumulate high levels of moisture and exhibit proportionally high current leakage between the heating element and the sheath. Thus, both hermetic and breathing seals have serious disadvantages when utilized in heating elements designed to operate at temperatures over 1000° F.

SUMMARY OF THE INVENTION

It is therefore an object of the present invention to provide a heating element which can operate at high temperatures without the disadvantages of the prior art.

It is a further object of the invention to provide a heating element having a seal which is substantially hermetic at low temperatures but which is permeable to oxygen at the operating temperature of the element.

In order to achieve these and other objects of the invention, an electric heating device is provided comprising:

a generally tubular sheath;

an elongated coil of electrical resistance heating wire passing through a portion of the sheath and spaced therefrom;

an elongated first metal terminal arranged at one end of the sheath, one end of the first terminal being electrically connected to one end of the wire at the interior of the sheath and spaced therefrom, the other end of the first terminal being exposed at the exterior of the sheath;

an elongated second metal terminal arranged at the other end of the sheath, one end of the second terminal being electrically connected to the other end of the wire at the interior of the sheath and spaced therefrom, the other end of the second terminal being disposed at the exterior of the sheath;

a mass of granular, heat conducting, electrically insulating material disposed within the sheath and embedding the wire and terminals and retaining the wire and terminals in spaced relation with the sheath;

a seal disposed at least one end of the sheath between the terminal and the sheath, the seal formed of a thermoplastic material having a melting temperature in the range of the temperature of the terminal when the heating device is in heated condition, the thermoplastic material being substantially permeable to gases while melted and substantially impermeable to gases while solid.

BRIEF DESCRIPTION OF THE DRAWINGS

The sole drawing Figure is a cross-section of a heating element according to the invention.

DETAILED DESCRIPTION OF THE INVENTION

Figure 1:
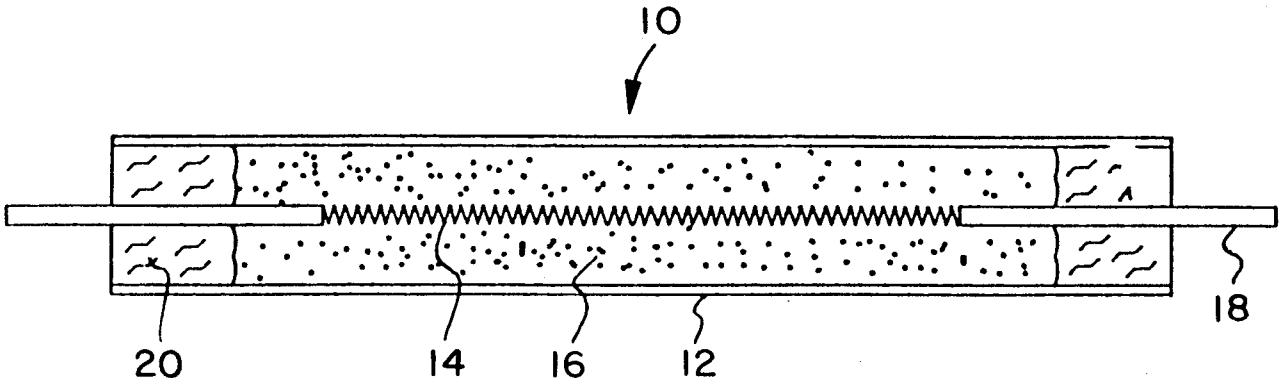

Shown in the drawing Figure is a typical tubular electrical heating device, generally designated as 10. The heating device includes a metal sheath 12, formed of a metal which is resistant to high temperatures such as Incoloy ®, a nickel chromium steel comprising about 30% by weight nickel and 20% by weight chromium. Other stainless-type steels may also be used as the sheath, as well as cobalt type steels, copper, and aluminum.

Passing through the sheath is a coil 14 of wire, typically Nichrome ® wire (80 Ni-20 Cr) which is heated to a high temperature when an electrical current is passed through it.

A compacted insulating powder 16, such as magnesium oxide powder, is disposed within the sheath embedding the coil of wire and serving to separate the coil of wire from the sheath. Attached to each end of the sheath is a terminal 18, a "cold pin", which may be formed of a mild steel plated with nickel and rolled. The cold pin may also be formed of an unplated, rolled mild steel or a stainless steel.

In the operation of the typical heating element shown in the Figure, the coil of Nichrome ® wire will achieve a temperature of about 1800° F., while the outside of the sheath will attain a temperature of about 1500° F. The terminal 18 does not attain these high temperatures, but rather remains at a temperature of about 185° F. as it passes through the ends of the sheath.

The end seal 20 of heating element 10 is formed of microcrystalline wax. Microcrystalline wax has been found to be the ideal thermoplastic material for utilization in the heating elements of the invention, as it has a melting point in the range of 130° to 200° F. At 185° F., the microcrystalline wax exists in a viscous, substantially liquid state in which it is permeable to gases but does not run out of the sheath. While microcrystalline wax is the ideal material for use as these end seals, other waxes and polymers may be utilized as well, as long as they are substantially liquid at the temperature of the terminal while the heater is in operation, permeable to gases in their liquid state, impermeable in the solid state, and stable and retainable within the sheath.

Resins which melt in the proper range include ( acetamide (mp 171–178° F.) and acrylic resins such as vinyl acrylic acid (mp 170° F.). Other waxes include Beeswax, Candelilla wax, Carnauba wax, Japan wax, paraffin wax, and mineral wax, as well as waxy materials such as soybean lecithin (mp 150° F.).

EXAMPLES

A series of test rods was prepared in various diameters of 0.260 and 0.312 inches. The rods were formed with a sheath of Incoloy ® stainless steel, a Nichrome ® heating element, cold pins formed of mild steel plated with nickel and rolled, and magnesium oxide insulation. The rods were assembled and annealed at a temperature of 2000° F. As the annealed rods were assumed to be moisture free, they were sealed as soon as they were removed from the annealing furnace.

The rods according to the invention were sealed by dipping the ends of the rods in molten wax maintained at a temperature of approximately 230° F. The wax used was "BE Square 195 Amber" produced by Boler Petroleum Company, a food safe, biodegradable, thermoplastic material containing no hazardous materials. Dip time was two minutes for each end. After dipping, the pin and sheath were brushed to remove the coat of wax.

Comparative rods were sealed in the normal manner, utilizing a silicone varnish known as 1-2577 conformal coating manufactured by Dow Corning.

Humidity Test

Ten rods prepared according to the invention and two rods prepared with silicone were placed in a humidity chamber at 90% relative humidity and 95° F. for 60 days. Each day resistance readings were taken on the test rods to determine moisture infiltration, with some moisture infiltration being indicated on all rods during the test period. After 60 days, the rods were removed and subjected to Underwriters Laboratories hot resistance and hot leakage tests, in which a voltage of 1250 volts AC is connected between the case and the terminal of the element, and resistance and current are measured therebetween. A passing rod has a resistance greater than 0.060 megohms and a leakage current of less than 25 milliamperes.

The only failure among the 12 rods, was in a single wax sealed rod which failed due to a puncture in the sheath and not due to a failure of the seal.

The remaining wax-sealed rods had hot resistances between 2 and 0.2 megohms, averaging 0.87 megohms. The two silicone sealed rods had resistances of 0.8 and 0.4 megohms, averaging 0.6 megohms.

The humidity test showed that the wax seal was able to provide an effective barrier to moisture contamination, and was comparable to the silicone seal.

THERMAL ENDURANCE TESTING

Six rods with wax seals were subjected to a 1000 cycle test as set forth by Underwriters Laboratories. At the completion of the test, the rods were subjected to Underwriters Laboratories hot resistance and leakage tests. All rods passed both tests.

Four wax sealed rods were connected to a test board and subjected to 1000 hours continuous operation. After the completion of the test, Underwriters Laboratories hot leakage and resistance tests were performed. All elements passed both tests.

An accelerated life test was conducted on 12 wax-sealed rods, six bake and six broil. The accelerated life test procedure consists of a total of 45 days operation in three stages, at the rated voltage, at 277 volts and at 300 volts. This test simulates 20 years of element use. At the end of the simulation, the rods were subjected to Underwriters Laboratories hot leakage and hot resistance tests and all rods passed the tests.

MIGRATION TEST

When a heating element is energized and cooled, air is expelled and drawn in, respectively. The sealant, fluid when hot, tends to be influenced such that the thermoplastic material is pushed outwardly when air is expelled and drawn inwardly as the rod cools. In the heating cycle, the wax does not leave the rod but concentrates at its ends. However, upon cooling, if the sealant migrates into the hot area this may cause a failure of the element.

At the conclusion of the thermal test described above, the rods tested were cut open to examine migration of the sealant. Observations revealed the maximum migration was only one inch. This depth is a considerable distance from the heat zone of the rods and therefore it is considered that there is little danger that the sealant will migrate into the heating area.

What is claimed is:

1. An electric heating device comprising:

a generally tubular sheath;

an elongated coil of electrical resistance heating wire passing through a portion of said sheath and spaced therefrom;

an elongated first metal terminal arranged at one end of said sheath, one end of said first terminal being electrically connected to one end of said wire at the interior of said sheath and spaced therefrom, the other end of said first terminal being disposed at the exterior of said sheath;

an elongated second metal terminal arranged at the other end of said sheath, one end of said second terminal being electrically connected to the other end of said wire at the interior of said sheath and spaced therefrom, the other end of said second terminal being disposed at the exterior of said sheath;

a mass of granular, heat conducting, electrically insulating material disposed within said sheath and embedding said wire and said terminals and retaining said wire and said terminals in spaced relation with said sheath;

a seal disposed at least one end of said sheath between said terminal and said sheath, said seal formed of a thermoplastic material having a melting temperature in the range of the temperature of the terminal when the heating device is in heated condition, said thermoplastic material being substantially permeable to gases while melted, and substantially impermeable to gases while solid.

2. An electric heating device according to claim 1, wherein said thermoplastic material comprises wax.

3. An electric heating device according to claim 2, wherein said wax is a microcrystalline wax.

4. An electric heating device according to claim 1, wherein said thermoplastic material has a melting temperature in the range of 130° to 190° F.

5. An electric heating device according to claim 1, wherein said generally tubular sheath is formed of metal.

6. An electric heating device according to claim 5, wherein said metal sheath is stainless steel.

7. An electric heating device according to claim 1, wherein said elongated coil is formed of Nichrome® wire.

8. An electric heating device according to claim 1, wherein said insulating material comprises magnesium oxide.

9. An electric heating device according to claim 1, wherein a said seal is disposed at both ends of said sheath.

10. An electric heating device according to claim 1, which is a broiling element.

11. An electric heating device according to claim 1, which is an oven heating element.

* * * * *